US010362867B2

(12) United States Patent
Williams

(10) Patent No.: US 10,362,867 B2
(45) Date of Patent: Jul. 30, 2019

(54) PILLOW RACK

(71) Applicant: Judith A. Williams, Novi, MI (US)

(72) Inventor: Judith A. Williams, Novi, MI (US)

( * ) Notice: Subject to any disclaimer, the term of this patent is extended or adjusted under 35 U.S.C. 154(b) by 638 days.

(21) Appl. No.: 14/880,678

(22) Filed: Oct. 12, 2015

(65) Prior Publication Data

US 2016/0106206 A1 Apr. 21, 2016

Related U.S. Application Data

(60) Provisional application No. 62/064,007, filed on Oct. 15, 2014.

(51) Int. Cl.

| | |
|---|---|
| ***A47B 81/00*** | (2006.01) |
| ***A47B 43/00*** | (2006.01) |
| ***A47B 55/02*** | (2006.01) |
| ***A47F 5/13*** | (2006.01) |

(52) U.S. Cl.

CPC ..... *A47B 81/00* (2013.01); *A47B 43/00* (2013.01); *A47B 55/02* (2013.01); *A47F 5/13* (2013.01)

(58) Field of Classification Search

CPC . A47B 43/00; A47B 55/02; A47F 5/13; A47F 7/0064; D06F 57/08; D06F 57/10; A47L 19/00; A47L 19/04

USPC .... 211/201, 41.5, 104, 181.1, 169, 41.6, 38, 211/200, 41.4, 202; 108/12

See application file for complete search history.

(56) References Cited

U.S. PATENT DOCUMENTS

| | | | | | |
|---|---|---|---|---|---|
| 160,980 | A | * | 3/1875 | Whipple | D06F 57/08 211/198 |
| 206,855 | A | * | 8/1878 | Bissell et al. | 248/98 |
| 222,542 | A | * | 12/1879 | Stearns | D06F 57/08 123/196 S |
| 329,150 | A | * | 10/1885 | Eaton | D06F 57/08 211/200 |
| 638,417 | A | * | 12/1899 | Miller, Jr. | D06F 57/08 211/183 |
| 846,263 | A | * | 3/1907 | Tibbits | A47L 19/04 211/41.4 |

(Continued)

FOREIGN PATENT DOCUMENTS

| | | | | | |
|---|---|---|---|---|---|
| CH | 185393 | A | * | 7/1936 | A47L 19/04 |
| CH | 500387 | A | * | 12/1970 | A47B 3/02 |

(Continued)

*Primary Examiner* — Stanton L Krycinski

(74) *Attorney, Agent, or Firm* — The Weintraub Group, P.L.C.

(57) ABSTRACT

A foldable rack for storing pillows comprising a first and second frame member being generally planar and rectangular, each frame member including: (a) an upper end and a lower end defining a length; (b) opposing lateral sides connecting the upper end and the lower end defining a width; (c) a plurality of spaced apart rods extending from the upper end to the lower end, each rod having a hub disposed at a central portion, each hub having an axial bore therethrough, each axial bore in registry; and (d) a pin being received in the axial bore extending through each hub of each rod. The rack folds about the pin in a scissor-like fashion between a first not in use position where the first and second frame members fold into juxtaposed position and a second in use position where the first and second frame members intersect to form an X shape.

6 Claims, 3 Drawing Sheets

(56) References Cited

U.S. PATENT DOCUMENTS 1,491,801 A * 4/1924 Holbrook ..... A47J 47/16 248/164
2,666,681 A * 1/1954 Adler ..... A47B 3/02 108/12
2,958,424 A * 11/1960 Bigatti ..... A47L 19/00 211/104
3,286,752 A * 11/1966 Duryee, Jr. ..... A47G 29/06 220/9.3
3,893,648 A * 7/1975 Gilbert ..... B65B 67/1255 248/150
D247,416 S * 3/1978 Berman ..... D32/55
4,723,741 A * 2/1988 Doering ..... B65B 67/1255 248/164
5,096,072 A * 3/1992 Link ..... A47F 5/13 211/130.1
5,470,039 A * 11/1995 Hilger ..... A47D 9/005 248/164
5,507,399 A * 4/1996 Hermanson ..... A47F 5/135 211/181.1
5,823,100 A * 10/1998 Wienhold ..... A21B 3/155 99/449
6,086,013 A * 7/2000 Looney, Jr. ..... B65H 49/321 242/129.5
D429,863 S * 8/2000 Lenney ..... D32/55
6,119,873 A * 9/2000 Matthews ..... A47F 7/0007 211/196
6,334,593 B2 * 1/2002 Inoue ..... 248/95
6,419,193 B1 * 7/2002 Rodriquez ..... B62B 3/106 248/101
6,722,618 B1 * 4/2004 Wu ..... B23D 47/025 208/116
7,032,868 B2 * 4/2006 Mutert ..... B65B 67/1205 141/391
7,168,580 B2 * 1/2007 Larimer ..... A47B 43/00 211/181.1
7,318,569 B1 * 1/2008 Bilotta ..... B65B 67/1205 248/164
7,475,785 B1 * 1/2009 Kidd ..... A47L 19/02 211/200
7,565,780 B2 * 7/2009 Pinto ..... A22C 11/125 24/30.5 R
7,578,401 B2 * 8/2009 Schnitzer ..... A47L 19/04 211/200
7,731,134 B1 * 6/2010 Mutert ..... B65B 67/1205 248/97
8,479,780 B2 * 7/2013 Fernandez ..... B65F 1/10 141/10
8,615,924 B2 * 12/2013 Dinihanian, Jr. ..... A01G 9/16 211/198
8,733,293 B2 * 5/2014 Link ..... A01K 1/0017 119/474
8,783,473 B1 * 7/2014 Schosek ..... A47G 25/0664 211/198
9,003,610 B2 * 4/2015 Schleucher ..... B65B 51/043 24/30.5 L
2005/0045569 A1 * 3/2005 Chang ..... A47B 43/00 211/11
2007/0012638 A1 * 1/2007 Van Eijk ..... D06F 57/08 211/104
2007/0251907 A1 * 11/2007 Li ..... A47B 3/087 211/195
2008/0283480 A1 * 11/2008 Segall ..... A47L 19/02 211/41.6
2014/0014607 A1 * 1/2014 Mikich ..... A47B 43/00 211/195
2015/0250309 A1 * 9/2015 McLoud ..... A47B 81/00 211/28

FOREIGN PATENT DOCUMENTS

FR 943816 A * 3/1949 ..... A47L 19/04
GB 174267 A * 1/1922 ..... A47L 19/00
GB 627197 A * 8/1949 ..... A47L 19/04

* cited by examiner

PILLOW RACK

CROSS-REFERENCE TO RELATED APPLICATIONS

This application is a completion application of co-pending U.S. Provisional Patent Application Ser. No. 62/064,007, filed Oct. 15, 2014, for "Pillow Rack," the entire disclosure of which is hereby incorporated by reference in its entirety including the drawings.

BACKGROUND OF THE INVENTION

1. Field of the Invention

The present invention pertains to storage racks, and more particularly to a storage rack for storing pillows that comprises a pair of frame members that are connected to one another in a scissors like fashion and form a collapsed low profile form for easy storage when the rack is in a first position and not in use and rotate into a second position wherein the frame members form an X wherein the pillows are stacked vertically atop one another for easy accessible temporary storage when the pillows are not in use.

2. Description of Related Art

Throw pillows or accent pillows are great additions that will complete any bedroom. Regardless of the style—modern, traditional, contemporary, or eclectic—if a bed looks drab, a homeowner will place a couple of colorful or trendy throw pillows on the bed to add some character. But when it's time to go to bed, where do you put all those pillows? As is usually the case, the pillows get tossed on the floor creating trip hazards or clutter until the bed is made up again. This is also very annoying in guest bedrooms, since your guest may not know what to do with all those pillows and will throw them on the floor or atop furniture possibly damaging lamps or accidentally forcing items to the floor.

Worse still, the floor just makes the pillow too attractive to bugs and pets, possible stains, and other contamination.

Accordingly, it would be desirable to have a means of keeping pillows and the like off the floor so as to obviate the need for the user to bend over to pick them up for replacement on the bed, or be placed on materials that might stain the pillow, or be exposed to the risk of bug infestation and contamination.

Because the room would look cluttered with unnecessary furniture, it would be desirable to have a storage rack that is portable and openable for ease of use when guests visit and collapsible into a compact form for storage when the guests leave and the rack is not needed. Storage could occur in spaces of 2"×24" hung in closet, placed along inside closed wall, behind dresser or displayed.

In modern society, many storing devices are known and currently available. By way of example, various storage devices and arrangements are illustrated in U.S. Pat. Nos. 1,716,862; 2,939,584; 4,828,123; 5,167,329; 5,213,221; 6,308,837; 6,443,321; 8,464,880; Des. 278,497; Des. 278,669; Patent Publication 2008/0283480; and CN 203195100U. These publications are specifically incorporated herein by reference as regards the conventional approaches and constructions taught therein.

Also, the above listed prior publications are identified herein in recognition of a duty of disclosure of related subject matter, which may be relevant under 37 CFR 1.56.

While each of the above devices may have been suitable for the uses and problems the invention then intended to solve, none appreciated or suggested a solution to the problem of providing a collapsible pillow storage rack which addresses ease of assembly to rapidly provide access to temporarily store pillows and prevent exposure to dirty floor surfaces and obviate awkwardness of bending down as well as providing a storage rack that is collapsible into compact form for storage when needed.

It is to be appreciated that there is a need for a storage rack for storing pillows which is collapsible for easy storage when the rack is not in use, lightweight and portable, easy to open for use, is structurally stable when placed in use, safe to use in the home, and inexpensive to make. Additionally, there are health needs pertaining to asthma and tripping hazards in bedrooms.

SUMMARY OF THE INVENTION

According to this invention, there is disclosed a foldable rack for storing pillows in vertically stacked relation against a wall extending vertically upwardly from a floor, comprising: (a) first and second frame members, each said frame being generally planar, rectangular, includes upper and lower ends and opposite lateral sides, and a central portion that divides the frame into upper and lower frame portions; and (b) means for connecting the central portions of the frame members together for rotating movement relative to one another between first and second positions.

The first position defines a condition wherein the rack is not in use and the respective upper and lower frame portions are folded into juxtaposed relation with one another. The second position defines a condition wherein the upper and lower frame portions rotate relative to one another to form an X shape profile wherein the upper frame portions are upwardly open and form a cradle adapted to receive and support pillows and the lower frame portions are downwardly open and respective lower ends adapted to support the rack on the floor.

In use, the upper and lower ends of the first frame abut against the wall and the floor, and the upper and lower ends of the second frame are spaced outwardly from the first frame and abut the floor. The arrangement permits the stacking of pillows atop the upper frame portion of the second frame and vertically upwardly against the upper frame portion.

Further, the central portions are connected for rotation by a pin that extends through the central portions and between the sides of the frame members and forms an axis of rotation. When the frame members rotate and the upper frame portions are in the upwardly open in use position, the frame portions form a cradle for supporting the pillows.

Desirably, when in the in use position, the upper frame portions are at an angle relative to the axis of rotation and form a cradle that will position the center of gravity, or weight of the combined stack, either generally above the axis of rotation about which the frame members rotate or slightly toward the wall, decreasing the potential for the rack to relatively rotate and become unstable.

Desirably, the respective frame members are connected in a scissors-like fashion such that when the rack is in the first position and not in use, the upper portions and the lower portions, respectively, are in substantially parallel juxtaposed facing relation with one another. The not in use mode provides a generally thin profile, is compact, and maximizes ease of storage.

According to this embodiment of the invention, the first frame is longer than the second frame and each comprises a plurality of elongated rods that extend in parallel relation between opposite lateral ends of the respective frame. The rods of one frame pass transversely through and dispose in alternating fashion with respect to the rods of the other frame.

Preferably, the number of rods of the second frame is greater than the number of rods in the first frame such that lateral width of the upper portion of the second frame is wider than the first frame and provides a wider horizontal supporting platform for pillow stacking.

Further and according to this embodiment, said means for connecting the frame members together comprises a hub at the central portion of at least two rods of each frame, each of the hubs being axially aligned with one another, said pin being axially elongated and extending through each of the hubs and between opposite lateral sides of the rack, the pin defining the axis of rotation and connecting the frame members together for rotation relative to one another.

In a preferred arrangement according to this embodiment of the invention, in the second and in use position, the lower ends of the first and second frame members are supported on the floor with the lower end of the second frame being seated in the right angled junction between the wall and the floor.

According to this arrangement, the axis of rotation is in a vertical plane between the lower ends of the lower frame members, and the lower end of the first frame is in a vertical plane between the axis of rotation and the upper end of the second frame.

Desirably, the rack having upper and lower ends of the two frame members abutted against a vertical room wall aids in supporting and stabilizing the pillow rack in the open position, resists rotational collapse of the frame members, enables a user to easily and rapidly position pillows in generally horizontally and vertically stacked relation, and increases the vertical height of the pillows that can be stacked using a smaller support rack. This is particularly helpful when the items being stacked might include first loading a bulky bedspread and the like on the supporting platform before adding the weight of more pillows provide by an upward vertical stack.

According to another preferred embodiment of this invention there is disclosed a foldable rack for storing pillows in vertically stacked relation, comprising: (a) a pair of generally rectangular and planar frame members each having, respectively, upper and lower ends, a pair of sides, and a central portion that divides the frame into an upper portion and a lower portion; (b) means for connecting the frame members together in a manner that the frame members rotate relative to an axis through the central portions from a not in use first position wherein the frame members are in generally parallel relation to one another and an open second position wherein the frame members form an X shape and the upper portions define an upwardly open cradle for receiving and supporting pillows in generally horizontal vertically stacked relation atop the pillows and the lower portions and their respective lower ends support the rack on a support surface; and (c) means for releasably locking the frame members in the open second position.

When in the in open, second, or in use position, the upper portions of the frame members are at an obtuse angle to one another.

According to this embodiment, the means for releasably locking comprises a U-shaped clip, having a pair of legs and a bight portion interconnecting the legs, and frame members provided with a pair of sockets sized to receive a respective of the legs, the sockets being disposed in like sides of the respective frame members and the clip legs preventing rotation between the frame members. The sockets may be vertically or horizontally separated. In the vertical approach, one and the other of said sockets is disposed in the side of the upper portion of one frame and in the side of the lower portion of the other frame. In the horizontal approach, one and the other of said sockets are disposed in respective sides of the lower portions of the two frame members.

If desired, the separation between sockets could be increased or decreased, or additional clips and sockets provided, depending on whether the user desires the lock the X form of the rack in a more open or more closed condition (i.e., the upwardly open cradle smaller or larger).

In an alternate arrangement, the means for releasably locking comprises a U-shaped clip, having a pair of legs and a bight portion interconnected the legs, being inserted above and below the pin and junctions formed between the frames. Preferably the cross-sections of the legs are V-shaped and formed by an obtuse angle adapted to match the obtuse angle formed by the surfaces of the frame members when upwardly open, the legs and respective surfaces forming a snug engagement with the frame members to prevent rotation.

According to this embodiment, each frame comprises a set of generally axially elongated rods that extend in parallel fashion between the opposite longitudinal ends thereof, each rod having a central portion and the respective rods of one frame extending in alternating relation between a respective pair of rods of the other frame, and said means for connecting comprises a pin joining the central portions of each rod, said pin extending between the opposite lateral sides of the frame members whereby to rotatably connect the pair of frame members together in a manner that the frame members rotate between the first and second positions.

Desirably a pillow rack according to this invention is thin in design, can be stored in hanging relation in a closet rod in sandwiched relation between shirts or other garments hung on the rod, is deployed or stored rapidly when needed or not in use. Further, the rack keeps bedding clean and safe, off the floor, freeing up open space for bed-making, and eliminates piled high chairs, and dresser tops. The rack design enables the user to select various clean designs or decorating styles.

These together with other aspects of the present invention, along with the various features of novelty that characterize the present invention, are pointed out with particularity in the claims annexed hereto and form a part of the present invention. For a better understanding of the present invention, its operating advantages, and the specific objects attained by its uses, reference should be made to the accompanying drawings and detailed description in which:

BRIEF DESCRIPTION OF THE DRAWING

FIG. 2 is a perspective view of the pillow rack according to the present invention, the rack including a pair of frame members in an open position for positioning against the room wall to receive and vertically stack pillows and the like;

DETAILED DESCRIPTION OF THE INVENTION

Figure 1:
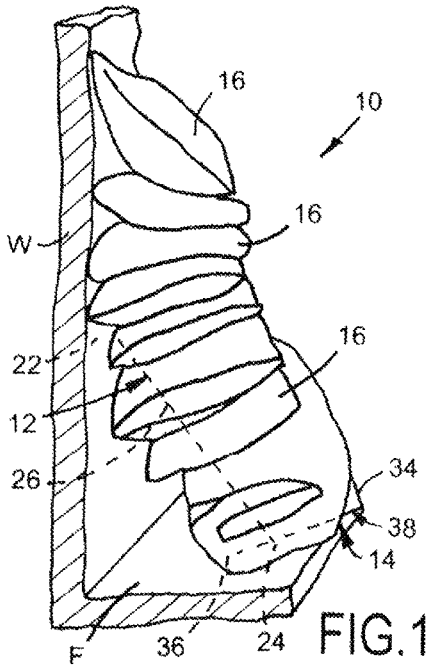
FIG. 1 is a perspective view of a pillow rack positioned against a vertical room wall and temporarily storing pillows, bedding material and the like in vertically stacked relation against the wall according to the present invention.
Figure 5:
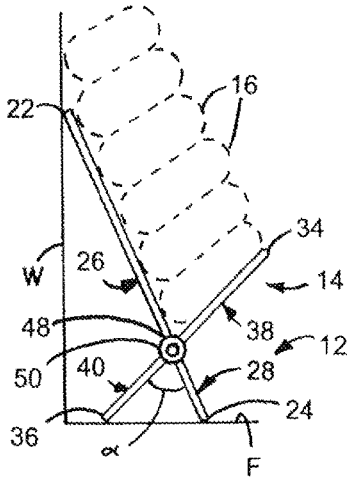
FIG. 5 is a side elevation view showing, schematically, the pillow rack when ready for use with the upper and lower ends of one frame members abutting the wall and the floor and the lower end of the other frame members supported on the floor.
Figure 6:
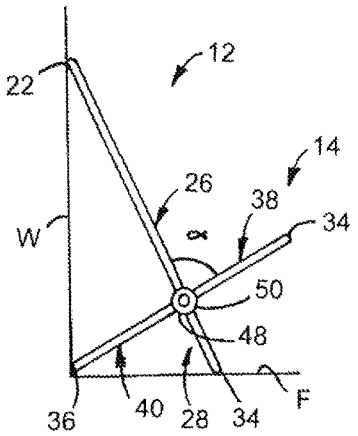
FIG. 6 is a side elevation view showing, schematically, the pillow rack when ready for use with the upper and lower ends of one frame abutting the wall and the floor and the lower end of the other frame seated in the junction between the wall and floor.

Turning now to the drawings, FIGS. 1-4 depict a pillow rack 10 for temporarily storing pillows, bedding, and like materials in a vertical stack when not in use and which provide easy access, such as in a bedroom when preparing the room for sleeping and turning down the bed. The pillow rack 10 includes a pair of frame members 12, 14 that rotate from a first position (FIGS. 3 and 4) when the rack 10 is not in use, the frame members 12, 14 are folded onto one another and the rack 10 is to be stored, into a second position (FIGS. 1 and 2) when the rack 10 is ready for use. In FIG. 1, the rack 10 is under the pillows and the frame members 12, 14 are shown by the phantom lines. FIGS. 5 and 6 are side elevation views showing arrangements of the pillow rack 10 positioned on a floor F and against a vertical wall W of the room.

FIGS. 1 and 5 show the pillow rack 10 wherein the frame members 12, 14 are in the in use position functioning to support the rack 10 against the floor F and the wall W. The frame members 12, 14 form a generally horizontal platform for supporting and temporarily storing a stack of pillows, bedding, and the like shown at 16 in vertically spaced relation above and from contact with the floor F. The frame members 12, 14 rotate into an X shape, in scissor-like fashion, with portions of the frame members 12, 14 cooperating to form an upwardly open cradle for receiving the pillows 16. The first frame member 12 extends vertically having one end 24 supported on the floor F and the other end 36 abutting the wall W.

The pillow stack 16 is first supported by the first frame member 12 and then continues vertically upwardly. If the stack is greater than the upward extension of the first frame member 12, the pillows could then continue and stacks against the vertical wall W.

In particular, the pillow rack 10 comprises the first frame member 12 and second frame member 14, each frame 12, 14 being generally planar and rectangular. The first frame member 12 has a length defined by an upper end 22 and a lower end 24, a width defined by opposite lateral sides 30, 32, a central portion 18 extending between the sides 30, 32, and an upper portion 26 and a lower portion 28 divided by the central portion 18. Similarly, the second frame member 14 has a length defined by an upper end 34 and a lower end 36, a width defined by opposite lateral sides 42, 44, a central portion 20 that extends between sides 42, 44, and an upper frame portion 38 and a lower frame portion 40 divided by the central portion 20. In a preferred embodiment, the second frame member 14 is wider and shorter than the first frame member 12.

In the embodiment herein, each frame member 12, 14 comprises a plurality of elongated rods 46 that extend in parallel relation to one another and between opposite lateral ends 22, 24 of the first frame 12 and lateral ends 34, 36 of the second frame member 14. While the term rod is used herein, a term for a decorative "rod", "bar", or shaft" would be a ballister.

The elongated rods 46 may be manufactured from a variety of different materials, depending on the application. By way of example, the rods 46 may be of wood, plastic (or like polymeric material), or of a suitable metal (e.g., steel, aluminum).

In the embodiment shown, the second frame member 14 includes a set of seven rods 46 and the first frame member 12 includes a set of six rods 46. Preferably, the number of rods 46 of the second frame member 14 is greater than the number of rods 46 in the first frame member 12 such that lateral width and respective upper frame portion 38 thereof that supports pillows is wider to provide a more adequate horizontal platform for load bearing and stabilizing pillow stacking. As noted herein, the upper frame portion 38 is also referred to as a platform. For aesthetics, the rods 46 of each set are of like shape and appearance, but, depending on their desired use, the rods 46 of each set could be different.

Figure 2:
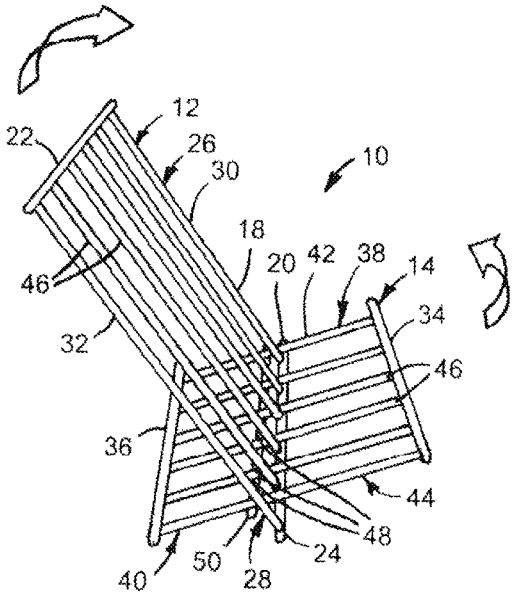

As shown best in FIG. 2, the set of rods 46 of the first frame member 12 pass transversely through and are disposed in alternating fashion with respect to the rods 46 of the second frame member 14.

Figure 3:
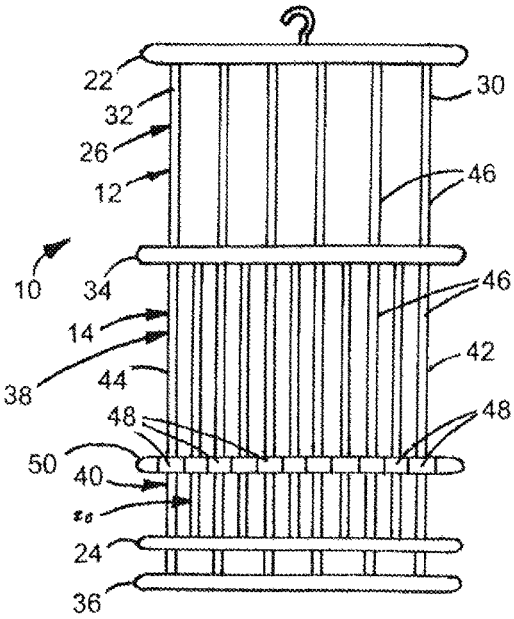
FIG. 3 is a plan side view of the pillow rack and the frame members in a collapsed storage position when the rack is not in use.

As shown best in FIG. 3, a central location of each rod 46 includes a hub 48, the hub 48 having a central axial bore therethrough. Collectively, the hubs 48 at the central location of the rods 46 form the central portions 18, 20 of the frame members 12, 14.

The frame members 12, 14 are connected together by a shaft or pin 50, the pin 50 being received in the axial bores that extend through each of the hubs 48. The pin 50 extends through each of the frame members 12, 14 and between the opposite lateral sides 30, 32 of the first frame member 12 and opposite lateral sides 42, 44 of the second frame member 14.

In the connection, the first frame member 12 is connected to the second frame member 14 in a manner that enables rotating movement of the frame members 12, 14 in scissor-like fashion relative to one another and between the first and second positions.

Figure 4:
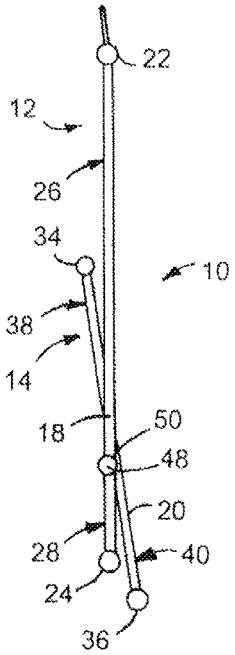
FIG. 4 is a side view of the pillow rack of FIG. 3 and the frame members in the collapsed position.

Referring to FIGS. 3 and 4, the frame members 12, 14 are shown in the first, "not in use," and second, "in use," positions. The not in use position folds and positions the respective upper frame portions 26, 38 and lower frame portions 28, 40 of the frame members 12, 14 into juxtaposed generally parallel relation with one another.

In FIG. 2, the frame members 12, 14 are in the second in use position wherein the upper frame portions 26, 38 and the lower frame portions 28, 40 have rotated relative to one another and away from one another to form an X shape. In this second position, the upper frame portions 26, 38 are upwardly open to form a cradle adapted to receive and support the pillows 16 and the lower frame portions 28, 40 are downwardly open and their respective lower ends 24, 36 positioned for supporting the rack 10 on the floor. For clarity, the wall W, floor F, and stack of pillows 18 are not shown.

As shown best in FIG. 5, in use, the upper end 22 of the first frame member 12 is abutted against the wall, the lower ends 24, 36 of the frame members 12, 14 are supported on the floor, and the upper end 34 of the second frame member 14 extends outwardly and away from the first frame member 12. The upper frame portions 26, 38 are generally at an acute angle α such that the end 34 of the pillow supporting upper frame portion 38 is spaced upwardly from the floor F.

Preferably, in a preferred embodiment, to limit or prevent the second frame member 14 from rotating relative to the first frame member 12, hook and loop fasteners (not shown) may be removably connected to respective dowel rods or wood slats when supported on the floor to maintain stability.

Figure 5A:
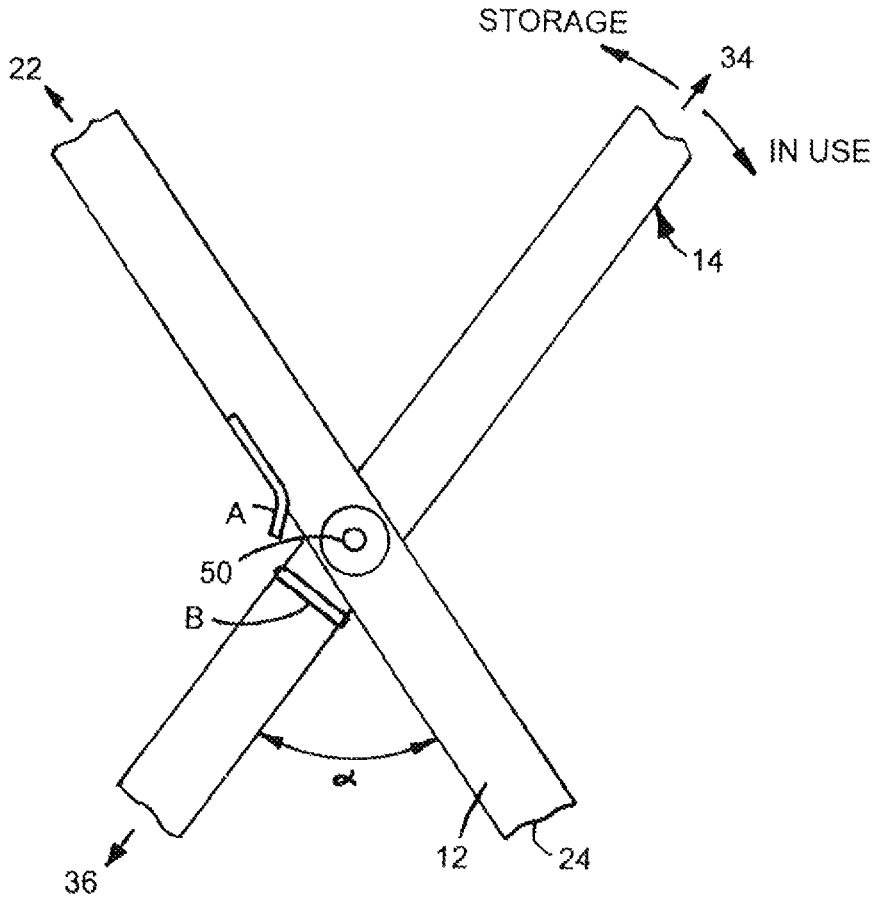
FIG. 5A is a partial side view showing the frame members of the rack shown in FIG. 2 in an open position and forming an X shape and showing an arrangement for limiting rotation between the frame members and positioning the frame members in a desired angle when in the open position.

Preferably, and in another preferred arrangement hereof, a rotation limiting arrangement may be provided. Referring to FIG. 5A, a raised clip or stop "A" projects outwardly from a side 30, 32 of the first frame member 12 and a raised clip or stop "B" projects outwardly from a side 42, 44 of the second frame member 14, opposite stop A. If stop A is on the lower portion 28 of the first frame member 12, stop B is on the upper portion 38 of the second frame member 14, and vice versa. As the frame members 12, 14 rotate relative to the pin 50 and away from a not in use position and towards the in use position, the stop B is brought against the stop A, limiting relative rotation between the frame members 12, 14 and position the frame members 12, 14 into the desired angle α and the in use position.

In one application, the rack 10 is approximately 1.8"× 24"×41" and, for maximum capacity, the rack 10 angle α was between 22.5° and 14.5°. The spacing between rods is about 4 inches.

The pin 50 and respective pivot axis of the frame members 12, 14 is generally such that the center of gravity of the pillows 16 passes through the pin 50 and is vertically aligned such that, in an extreme case, a load on the platform by the pillow stack will not cause tipping or downward rotating collapse of the upper frame portion 38.

In FIG. 6, according to another preferred embodiment, the rack 10 is positioned as described in FIG. 5 except that the lower end 36 of the frame member 14 is seated in the junction between the wall W and the floor F. Desirably, the wall inhibits upward rotation of the lower frame portion 40 of the second frame member 14 due to a pillow or bedding of unusual weight being placed on the platform or upper frame portion 38 of the first second member 14. Depending on the dimensions of the frame members 12, 14 and their respective angles relative between one another, the floor F, and the wall W, the lower end 36 increases stability of the arrangement inhibits the ability of downward loads to rotate the seconds frame member 14 and rotating movement of the platform 38.

Figure 7A:
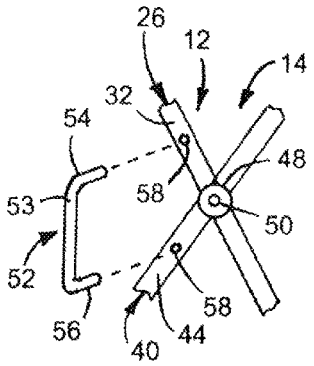
FIGS. 7A, 7B, and 7C are partial side views showing the frame members of the rack shown in FIG. 2 in an open position and forming an X shape and showing alternate arrangements for locking the frame members in the open position when the rack is used in a stand-alone position.
Figure 7B:
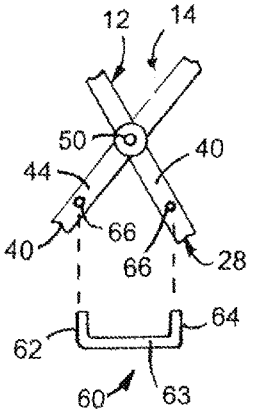
Figure 7C:
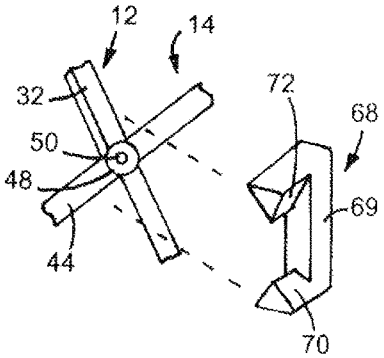

FIGS. 7A, 7B, and 7C disclose alternate preferred embodiments of this invention. The rack 10 is as described above (and depicted in FIG. 2), but is used in a stand-alone manner, separate and apart from the wall W. The rack 10 is provided with an arrangement for locking the frame members 12, 14 preventing unwanted rotation when the rack 10 is upwardly open and in the second position.

In FIG. 7A, there is provided a U-shaped clip 52 having a pair of legs 54, 56 and a bight portion 53 interconnecting the legs 54, 56, the legs 54, 56 at substantially right angles or perpendicular to the bight portion 53. The side 32 of upper frame portion 26 of the first frame member 12 and the side 44 of lower frame portion 40 of the second frame member 14, respectively, are provided with a socket 58, the sockets 58 being vertically disposed and the legs 54, 56 of the clip 52 being adapted to be inserted into respective sockets 58. The clip 52 thereby locks and prevents rotation between the frame members 12, 14.

In FIG. 7B, there is provided a U-shaped clip 60 having a pair of legs 62, 64 and a bight portion 63 interconnecting the legs 62, 64, the legs 62, 64 at substantially right angles or perpendicular to the bight portion 63. The side 44 of lower frame portion 40 of the second frame member 14 and the side 32 of lower frame portion 28 of the first frame member 12, respectively, are provided with a socket 66, the sockets being horizontally disposed and the legs 62, 64 being adapted to be inserted into respective sockets 66. The clip 60 thereby locks and prevents rotation between the frame members 12, 14.

In FIG. 7C, there is provided a U-shaped clip 68 having a pair of legs 70, 72 and a bight portion 69 interconnecting the legs 70, 72, the legs 70, 72 at substantially right angles or perpendicular to the bight portion 69. The legs 70, 72 have V-shaped cross-sections or angled surfaces and are adapted to be inserted above and below the pin 50 and junctions formed between the frame members 12, 14. Preferably, the angled surfaces of the legs 70, 72 are formed by an angle adapted to match the angle formed by the frame members 12, 14 when disposed in their X shape. The angled surfaces of the legs 70, 72 and angle formed by the frame members 12, 14 adjacent to the pin 50 engage and form a snug engagement to prevent rotation.

As shown, the legs 70, 72 are shown fitting in the upper and lower intersections between the frame members 12, 14, but could be adapted to conform and fit the horizontally open intersections between the frame members 12, 14 as well. In either arrangement, the clip 68 operates to lock the frame members 12, 14 from relative rotation.

In some applications, in a preferred embodiment according to this invention, a treaded relation between the axial bore through the hubs 48 and the pin 50 would enable the user to rotate the lateral hubs 48 joined at the end of the second frame member 14 relative to the pin 50 and drive all of the hubs 48 together and into frictional engagement, preventing relative rotation of the frame members 12, 14. Desirably, the frictionally engaged hubs 48 would prevent relative rotation of the frame members 12, 14 and releasably lock and maintain the rack 10 in the first position for storage and the second in use position use for stacking pillows.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described the invention, what is claimed is:

1. A foldable rack for storing pillows comprising:

(a) a first frame member and a second frame member, the first and second frame members each being generally planar and defined by a first end, a second end, and opposite lateral sides connecting the first end and the second end, the first and second frame members having an upper portion and a lower portion defined by a central axis;

(b) a plurality of rods extending between the first end and the second end of the first and second frame members;

(c) a plurality of hubs, each hub of the plurality of hubs being disposed on an associated rod of the plurality of rods at the central axis of both the first and second frame members, each hub having an axial bore formed therethrough, the axial bores being in registry with each other, wherein the hubs of the first and second frame members abut one another and form a stable substantially continuous sleeve with a substantially continuous bore; and (d) an elongated pin extending through the axial bores of each hub thereby rotatably joining the first frame member to the second frame member at the central axis.

2. The rack of claim 1 further comprising:

(a) a first socket extending within the upper portion of the first frame member;

(b) a second socket extending within the lower portion of the second frame member; and (c) a U-shaped clip having a first leg, the first leg having a first end and a second end, a second leg, the second leg having a first end and a second end, and a bight portion having a length interconnecting the first end of the first leg and the first end of the second leg, the first and second legs being substantially perpendicular to the bight portion, the second end of the first leg being insertable into the first socket and the second end of the second leg being insertable into the second socket, the length of the bight portion defining the position of the first and second frame members.

3. The rack of claim 1 further comprising:

(a) a first socket extending within the lower portion of the first frame member;

(b) a second socket extending within the lower portion of the second frame member; and (c) a U-shaped clip having a first leg, the first leg having a first end and a second end, a second leg, the second leg having a first end and a second end, and a bight portion having a length interconnecting the first end of the first leg and the first end of the second leg, the first and second legs being substantially perpendicular to the bight portion, the second end of the first leg being insertable into the first socket and the second end of the second leg being insertable into the second socket, the length of the bight portion defining the position of the first and second frame members.

4. The rack of claim 1 further comprising:

a U-shaped clip having a first leg, a second leg, and a bight portion interconnecting the first leg and the second leg, the first and second legs being substantially perpendicular to the bight portion, the first and second legs having angled surfaces pointing inwardly, the first and second legs removably placed on opposite sides of the hub between adjacent ones of the lateral sides of the first and second frame members, wherein the angled surfaces restrict rotation of the first and second frame members.

5. The rack of claim 1 further comprising:

(a) a first clip secured to one of the lateral sides of the first frame member, the first clip projecting outwardly from the lateral side of the first frame member and proximate to the elongated pin at the central axis; and (b) a second clip secured to one of the lateral sides of the second frame member, opposite the first clip, projecting outwardly from the lateral side of the second frame member and proximate to the elongated pin at the central axis, and wherein the first clip and the second clip reach a point of contact upon the first frame member and the second frame member rotating and prohibit further rotation past the point of contact.

6. The rack of claim 1 wherein the upper ends of the upper portions are distal to the hubs and the lower ends of the lower portions support the rack on the floor, and comprising; a plurality of pillows, wherein the plurality of pillows is stacked vertically on and against the upper portions.

* * * * *